US010496012B1

(12) United States Patent
Kuramoto et al.

(10) Patent No.: US 10,496,012 B1
(45) Date of Patent: Dec. 3, 2019

(54) DEVELOPING DEVICE AND IMAGE FORMING APPARATUS

(71) Applicant: FUJI XEROX CO., LTD., Tokyo (JP)

(72) Inventors: Shinichi Kuramoto, Kanagawa (JP); Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/286,621

(22) Filed: Feb. 27, 2019

(30) Foreign Application Priority Data

Sep. 21, 2018 (JP) ..... 2018-178134

(51) Int. Cl.
*G03G 15/08* (2006.01)
*G03G 15/09* (2006.01)
*G03G 21/20* (2006.01)

(52) U.S. Cl.
CPC ..... *G03G 15/0891* (2013.01); *G03G 15/0806* (2013.01); *G03G 15/0921* (2013.01); *G03G 21/206* (2013.01); *G03G 2221/1645* (2013.01)

(58) Field of Classification Search
CPC ..... G03G 15/0891; G03G 15/0865; G03G 15/0896; G03G 15/0921; G03G 21/206; G03G 2221/1645
See application file for complete search history.

(56) References Cited

U.S. PATENT DOCUMENTS

| | | | | |
|---|---|---|---|---|
| 9,128,418 | B2 * | 9/2015 | Okuma | G03G 15/0942 |
| 9,244,376 | B2 | 1/2016 | Kuramoto et al. | |
| 9,709,927 | B1 * | 7/2017 | Bacelieri | G03G 15/0921 |
| 9,804,531 | B2 * | 10/2017 | Fujimori | G03G 15/081 |
| 2017/0336734 | A1 * | 11/2017 | Nagashima | G03G 15/0891 |

FOREIGN PATENT DOCUMENTS

| | | |
|---|---|---|
| JP | 2005346035 | 12/2005 |
| JP | 2008039965 | 2/2008 |
| JP | 2015072331 | 4/2015 |

* cited by examiner

*Primary Examiner* — Sandra Brase
(74) *Attorney, Agent, or Firm* — JCIPRNET

(57) ABSTRACT

A developing device includes: a container for accommodating developer, the container having an exhaust port and an opening; an air flow path having an inlet of air directed to the exhaust port and through which the air passes; a cylindrical rotation member disposed at the opening in the container and is rotated such that a portion thereof facing the interior of the container moves upward; a transport member that rotates about a rotation axis extending along the rotation member and transports the developer inside the container; and an attachment magnetic pole that is disposed inside the rotation member and that allows the developer transported by the transport member to attach to the rotation member. The inlet of the air flow path is located above the attachment magnetic pole in a top-bottom direction. The inlet is located farther from the attachment magnetic pole than the rotation axis of the transport member is in the horizontal direction.

14 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2018-178134 filed Sep. 21, 2018.

BACKGROUND

(i) Technical Field

The present disclosure relates to developing devices and image forming apparatuses.

(ii) Related Art

Japanese Unexamined Patent Application Publication No. 2008-39965 discloses a configuration in which: a cover that covers an upper part of a developer carrier is formed such that an end of the cover is located on the upstream side of transport poles, which transport developer, in a developer transport direction; a constant-width gap is formed between the developer carrier and the cover; and an airflow directed in one direction is formed in the gap.

Japanese Unexamined Patent Application Publication No. 2015-72331 discloses a configuration having: an introduction flow path through which air is introduced into a container, the introduction flow path having an introduction port provided on the downstream side of a supply area in the rotation direction of a rotary member; and a discharging flow path through which the air in the container is discharged from a discharge port. The discharge port and the introduction port are disposed side-by-side.

Japanese Unexamined Patent Application Publication No. 2005-346035 discloses a configuration in which a gas flow path is formed such that gas flows into an apparatus from a space between a case and a developer carrier having passed through the position where it faces an image carrier, and the gas is discharged outside the apparatus through an opening.

SUMMARY

In a developing device, if the internal pressure of a container accommodating developer is high, it is desirable to provide an exhaust port to release the air inside the container to the outside. In that case, if the air directed to the exhaust port contains the developer, the developer is likely to be discharged outside the developing device.

Aspects of non-limiting embodiments of the present disclosure relate to a reduction in the amount of the developer discharged from the developing device, compared with a configuration in which an inlet of the air directed to the exhaust port is located below a magnetic pole that attracts the developer or at a position closer to the magnetic pole than the rotation axis of a developer transport member is.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including: a container for accommodating developer, the container having an exhaust port and an opening; an air flow path having an inlet of air directed to the exhaust port and through which the air passes; a cylindrical rotation member disposed at the opening in the container and is rotated such that a portion thereof facing the interior of the container moves upward; a transport member that rotates about a rotation axis extending along the rotation member and transports the developer inside the container; and an attachment magnetic pole that is disposed inside the rotation member and that allows the developer transported by the transport member to attach to the rotation member. The inlet of the air flow path is located above the attachment magnetic pole in a top-bottom direction. The inlet is located farther from the attachment magnetic pole than the rotation axis of the transport member is in the horizontal direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the attached drawings.

Figure 1:
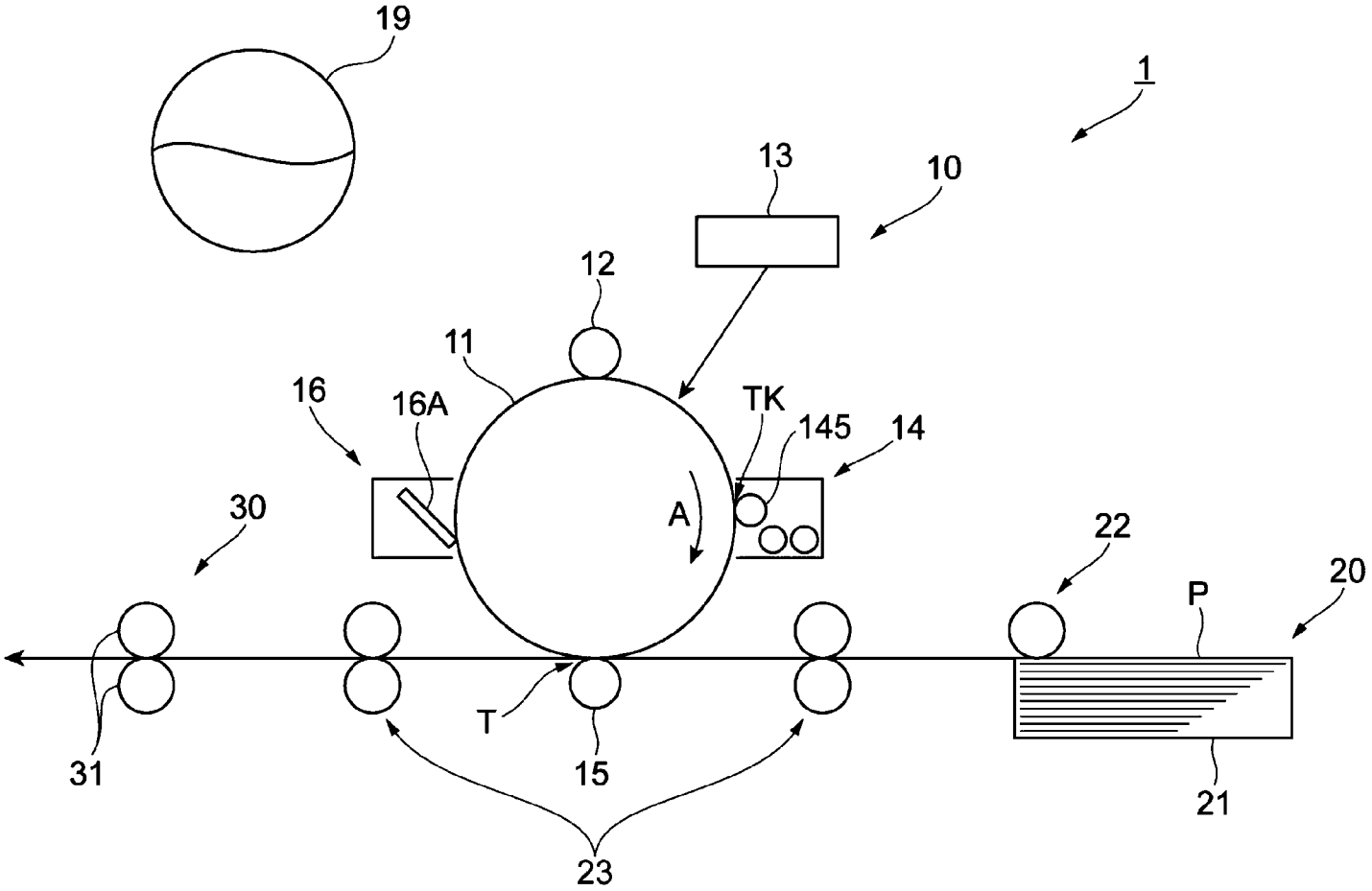
FIG. 1 shows the overall configuration of an image forming apparatus.

FIG. 1 shows the overall configuration of an image forming apparatus 1. More specifically, FIG. 1 shows the image forming apparatus 1, as viewed from the front side.

The image forming apparatus 1 includes an image forming unit 10, a sheet feed unit 20, and a fixing unit 30.

The image forming unit 10 forms a toner image on a sheet P by using an electrophotographic system. The sheet feed unit 20 supplies a sheet P to the image forming unit 10. The fixing unit 30 fixes the toner image (image), which has been formed on the sheet P by the image forming unit 10, to the sheet P.

The image forming unit 10 includes: a photoconductor drum 11, which rotates in the arrow A direction; a charging roller 12; an exposure device 13; a developing device 14; a transfer roller 15; and a cleaning device 16.

The photoconductor drum 11, serving as an example image carrier, is a cylindrical member and has a photosensitive layer (not shown) on the surface thereof.

The charging roller 12 is formed of, for example, a conductive rubber roller and charges the photoconductor drum 11.

The exposure device 13 irradiates the photoconductor drum 11 charged by the charging roller 12 with light emitted from a light source, such as a laser light source or a light emitting diode (LED), to form an electrostatic latent image on the surface of the photoconductor drum 11.

The developing device 14 allows toner of a predetermined color to attach to the surface of the photoconductor drum 11, thus developing the electrostatic latent image formed on the photoconductor drum 11. This way, the toner image is formed on the surface of the photoconductor drum 11 in this exemplary embodiment.

The developing device 14 accommodates developer. In this exemplary embodiment, the developer is a so-called two-component developer, which is composed of magnetic carrier and colored toner.

Furthermore, in this exemplary embodiment, a developer container 19 that accommodates developer to be supplied to the developing device 14 is provided. In this exemplary embodiment, new developer is supplied from the developer container 19 to the developing device 14 through a developer transport path (not shown).

The transfer roller 15 is formed of a conductive rubber roller or the like.

In this exemplary embodiment, the portion at which the transfer roller 15 and the photoconductor drum 11 face each other constitutes a transfer part T, and the toner image formed on the surface of the photoconductor drum 11 (i.e., the toner image held on the photoconductor drum 11) is transferred to a sheet P transported thereto, at the transfer part T.

The cleaning device 16 includes a contact member 16A disposed so as to be in contact with the photoconductor drum 11. The cleaning device 16 removes the toner and the other substances on the photoconductor drum 11.

The sheet feed unit 20 includes a sheet container 21, which accommodates sheets P, and a feed mechanism 22, which feeds a sheet P from the sheet container 21.

Furthermore, in this exemplary embodiment, sheet transport mechanisms 23, which transport, via the transfer part T and the fixing unit 30, the sheet P fed out from the sheet feed unit 20 are provided.

The fixing unit 30 includes a pair of rotary members 31, which rotate in a contact state.

One of the pair of rotary members 31 has a built-in heat source (not shown).

The two rotary members 31 in the fixing unit 30 apply heat and pressure to the sheet P to fix the toner image formed on the sheet P to the sheet P.

An image forming operation performed by the image forming apparatus 1 will be described.

In the image forming unit 10, the photoconductor drum 11 rotating in the arrow A direction is charged by the charging roller 12. Subsequently, the exposure device 13 exposes the photoconductor drum 11 to light to form, on the surface thereof, an electrostatic latent image corresponding to image information.

Subsequently, the developing device 14 develops the electrostatic latent image, thus forming a toner image corresponding to the electrostatic latent image on the surface of the photoconductor drum 11.

The toner image formed on the photoconductor drum 11 is moved to the transfer part T as the photoconductor drum 11 rotates. A sheet P fed out of the sheet feed unit 20 is transported to the transfer part T by the sheet transport mechanisms 23.

The toner image formed on the photoconductor drum 11 is transferred to the sheet P transported thereto at the transfer part T. Subsequently, the sheet P having the toner image transferred thereto is heated and pressed while passing through the fixing unit 30. Thus, the toner image is fixed to the sheet P.

Figure 2:
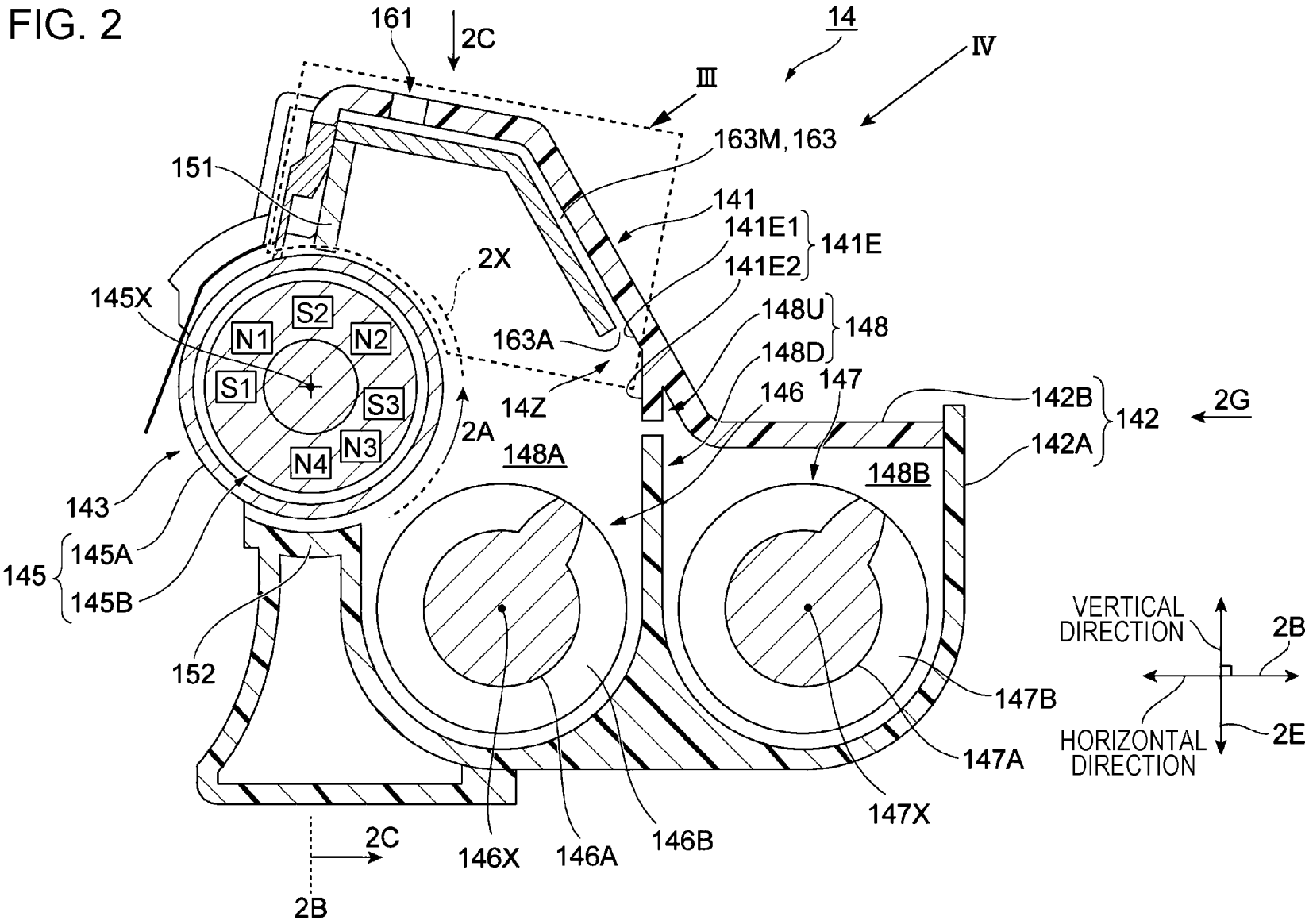
FIG. 2 shows a developing device.

FIG. 2 shows the developing device 14.

The developing device 14 includes a container 141 that accommodates developer (not shown) therein. The container 141 includes a container frame 142, which is made of resin.

The container frame 142 (developing device 14) extends in the direction from the front side to the rear side of the image forming apparatus 1 (see FIG. 1) (i.e., the direction perpendicular to the plane of the sheet of FIG. 2) and has a far-side end (not shown) on the rear side and a near-side end (not shown) on the front side.

The container frame 142 includes a lower housing 142A, which is located on the lower side, and an upper housing 142B, which is located above the lower housing 142A.

The container frame 142 has an opening 143 at a portion facing the photoconductor drum 11 (see FIG. 1). A developing roller 145 that allows the developer to attach to the surface of the photoconductor drum 11 is provided at the opening 143.

The developing roller 145 has a cylindrical shape and extends in the direction from the front side to the rear side of the image forming apparatus 1 (i.e., the direction perpendicular to the plane of the sheet of FIG. 2). The developing roller 145 extends in the longitudinal direction of the developing device 14.

The developing roller 145 includes a developing sleeve 145A, which is a tubular member that is rotationally driven, and a magnet roller 145B disposed inside the developing sleeve 145A.

The developing sleeve 145A, serving as an example rotation member, is formed of a metal, such as stainless steel (SUS). The developing sleeve 145A rotates in the arrow 2A direction in FIG. 2.

In other words, the developing sleeve 145A rotates in such a manner that a portion thereof facing the interior of the container 141 (i.e., a portion located inside the container 141) moves upward.

More specifically, the developing sleeve 145A rotates in such a manner that a portion located on the arrow 2C side with respect to the dashed line 2B moves upward.

In this exemplary embodiment, the developing sleeve 145A and the photoconductor drum 11 rotate so as to move in the same direction at a facing part TK (see FIG. 1), where the developing roller 145 and the photoconductor drum 11 face each other.

As shown in FIG. 2, the developing device 14 includes a first transport member 146 and a second transport member 147, which transport the developer.

The first transport member 146 and the second transport member 147 are provided on the opposite side of the developing roller 145 from the photoconductor drum 11 (see FIG. 1).

The first transport member 146, serving as an example transport member, has a rotation axis 146X extending along a rotation axis 145X of the developing sleeve 145A that is rotationally driven. The first transport member 146 rotates about the rotation axis 146X and transports the developer in the container 141.

More specifically, the first transport member 146 has a cylindrical part 146A extending along the rotation axis 145X of the developing sleeve 145A, and a spiral part 146B having a spiral shape and projecting from the outer circumferential surface of the cylindrical part 146A. The first transport member 146 pushes the developer with the spiral part 146B to transport the developer in the axial direction of the first transport member 146.

In this exemplary embodiment, the "rotation axis 146X" is the portion where the axis of the first transport member 146 is located, and not the cylindrical part 146A of the first transport member 146. The "rotation axis 146X" is the center of rotation of the first transport member 146.

In this exemplary embodiment, the developing roller 145 and the first transport member 146 overlap each other in the horizontal direction (i.e., in the arrow 2B direction in FIG. 2).

More specifically, the developing roller 145 and the first transport member 146 overlap each other when the developing roller 145 and the first transport member 146 are viewed from above (in the arrow 2C direction).

The second transport member 147 also has a rotation axis 147X extending along the rotation axis 145X of the developing sleeve 145A. The second transport member 147 rotates about the rotation axis 147X and transports the developer in the container 141.

The second transport member 147 also has a cylindrical part 147A extending along the rotation axis 145X of the developing sleeve 145A, and a spiral part 147B having a spiral shape and projecting from the outer circumferential surface of the cylindrical part 147A. The second transport member 147 also pushes the developer with the spiral part 147B to transport the developer in the axial direction of the second transport member 147.

In this exemplary embodiment, the first transport member 146 is located closer to the photoconductor drum 11, and the second transport member 147 is located farther from the photoconductor drum 11.

The first transport member 146 and the second transport member 147 are located below the developing roller 145. More specifically, in this exemplary embodiment, the rotation axis 146X of the first transport member 146 and the rotation axis 147X of the second transport member 147 are located below the rotation axis 145X of the developing sleeve.

In this exemplary embodiment, although the first transport member 146 and the second transport member 147 are located below the developing roller 145, the first transport member 146, the second transport member 147, and the developing roller 145 partially overlap one another.

The developing roller 145, the first transport member 146, and the second transport member 147 overlap one another in the top-bottom (vertical) direction (i.e., the arrow 2E direction).

In other words, the developing roller 145, the first transport member 146, and the second transport member 147 overlap one another when viewed from the side (i.e., in the arrow 2G direction).

The first transport member 146 extends in the direction from the front side to the rear side of the image forming apparatus 1 (i.e., the direction perpendicular to the plane of the sheet of FIG. 2) and transports the developer to, for example, the far side of the plane of the sheet of FIG. 2 (i.e., the rear side of the image forming apparatus 1).

The second transport member 147 is also disposed so as to extend in the direction from the front side to the rear side of the image forming apparatus 1 (i.e., the direction perpendicular to the plane of the sheet of FIG. 2). The second transport member 147 transports the developer to, for example, the front side of the plane of the sheet of FIG. 2 (i.e., the front side of the image forming apparatus 1).

In this exemplary embodiment, the interior space of the container frame 142 is divided by a vertically extending partition wall 148 into a first space 148A, which is located closer to the photoconductor drum 11, and a second space 148B, which is located farther from the photoconductor drum 11.

In this exemplary embodiment, the first transport member 146 is disposed in the first space 148A, and the second transport member 147 is disposed in the second space 148B.

The partition wall 148 includes an upper partition wall 148U and a lower partition wall 148D.

The partition wall 148 does not extend from end to end in the longitudinal direction of the container frame 142 (developing device 14). That is, the partition wall 148 is not provided at the far-side end and the near-side end of the container frame 142.

In other words, there are non-wall portions (i.e., portions where the partition wall 148 is not formed) at both ends in the longitudinal direction of the container frame 142.

This configuration allows the developer to circulate inside the developing device 14 in this exemplary embodiment.

More specifically, in this exemplary embodiment, the developer in the first space 148A is transported to the far side of the plane of the sheet of FIG. 2 by the first transport member 146. The developer that has reached the far-side end of the container frame 142 moves into the second space 148B through the non-wall portion.

The developer that has moved to the second space 148B is transported to the near-side end of the container frame 142 by the second transport member 147. Then, the developer moves to the first space 148A through the non-wall portion on the near-side end.

The developer repeatedly moves in this way, circulating in the developing device 14. In this exemplary embodiment, the developer is stirred by this circulation.

In the developing device 14, a layer restriction part 151 is provided above the developing roller 145. This layer restriction part 151 is disposed at a certain distance (gap) from the developing roller 145.

The layer restriction part 151 controls the thickness of the developer attached to the surface of the developing roller 145 to a predetermined thickness by preventing movement of part of the developer attached to the developing roller 145.

The developing device 14 has a lower facing part 152, which faces the developing roller 145, below the developing roller 145.

In this exemplary embodiment, the opening 143 is provided between the layer restriction part 151 and the lower facing part 152, and the developing roller 145 is provided in the opening 143.

Next, the magnet roller 145B disposed inside the developing sleeve 145A will be described.

The magnet roller 145B includes seven magnetic poles, namely, magnetic poles N1 to N4 (N poles) and magnetic poles S1 to S3 (S poles), which are arranged in the circumferential direction of the magnet roller 145B.

The magnetic pole N3 (pickup pole), serving as an example attachment magnetic pole, attracts the developer transported by the first transport member 146 and allows the developer to attach to the surface of the developing sleeve 145A. More specifically, the magnetic pole N3 allows the developer to attach to a portion of the surface of the developing sleeve 145A facing the interior of the container 141.

The magnetic pole S2 (trimming pole), together with the layer restriction part 151, controls the thickness of the developer attached to the surface of the developing roller 145 to a predetermined thickness.

The magnetic poles S3, N2, and N1 serve as transport poles, which transport the toner on the developing sleeve 145A to the downstream side in the rotation direction of the developing sleeve 145A.

The magnetic pole S1 (developing pole), together with the magnetic pole N1 adjacent thereto, form a nap of the developer.

The magnetic pole N4 (pickoff pole), together with the magnetic pole N3 adjacent thereto, forms a repulsive magnetic field to remove the developer attached to the surface of the developing sleeve 145A from the developing sleeve 145A. As a result, the developer attached to the developing sleeve 145A returns (moves) to the first transport member 146.

Figure 3:
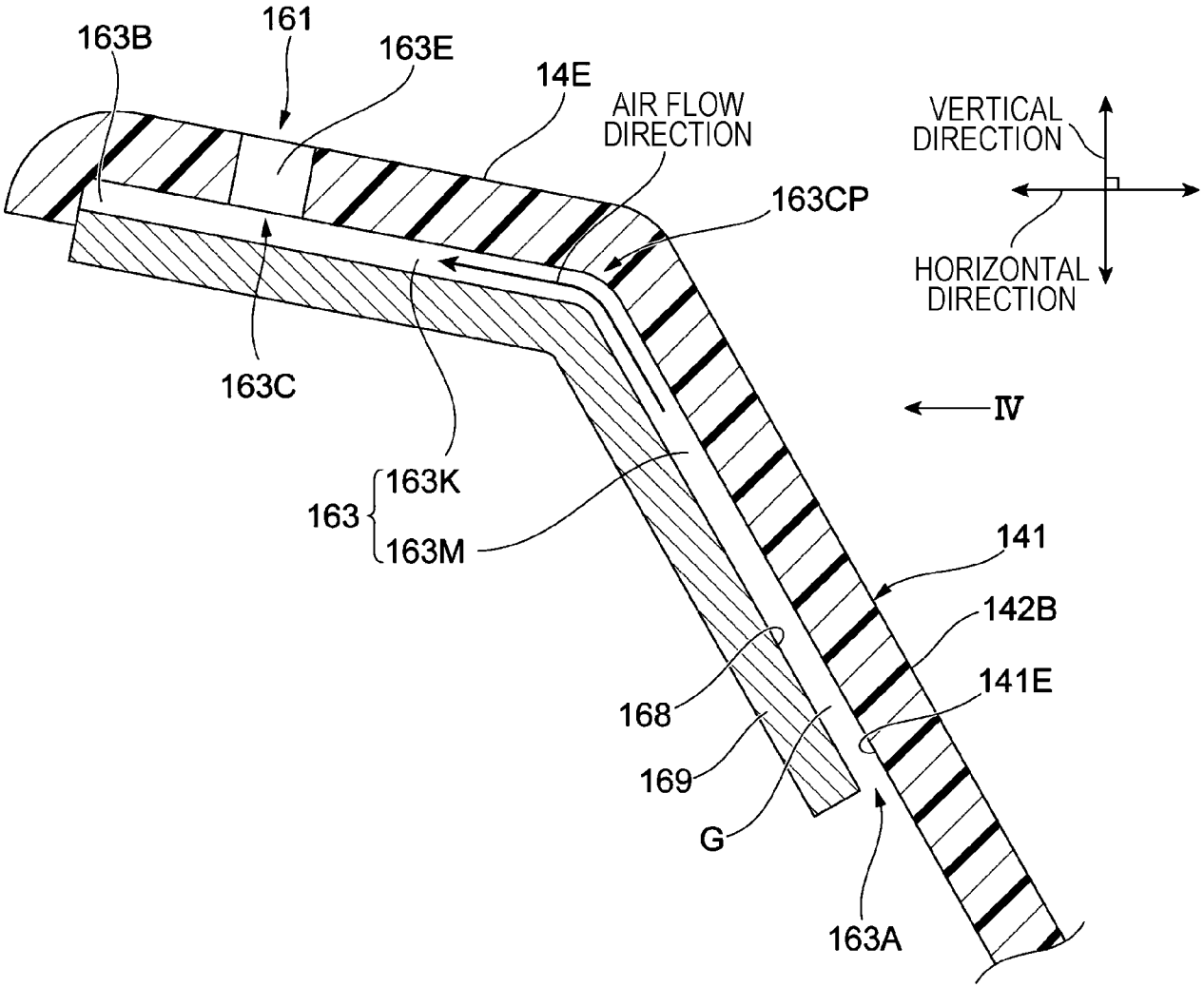
FIG. 3 is an enlarged view of a portion III in FIG. 2.

FIG. 3 is an enlarged view of the portion III in FIG. 2.

As shown in FIG. 3, in this exemplary embodiment, the container 141 (the upper housing 142B) has an exhaust port 161 through which the air inside the container 141 is discharged outside the container 141. The exhaust port 161 is provided in a top surface 14E of the developing device 14.

In this exemplary embodiment, the developer that is attached to the surface of the developing sleeve 145A (see FIG. 2) and that has passed through the facing part TK (see FIG. 1), at which the developing roller 145 and the photoconductor drum 11 face each other, returns to the container 141. The return of the developer to the container 141 increases the internal pressure of the container 141. To counter this situation, in this exemplary embodiment, the exhaust port 161 is formed to release the air inside the container 141 to the outside, thus suppressing an increase in the internal pressure of the container 141.

An air flow path 163, through which the air directed toward the exhaust port 161 passes, is provided inside the container 141.

The air flow path 163 has an inlet 163A, from which the air directed toward the exhaust port 161 enters. The air flow path 163 also has an end 163B at the end opposite to the inlet 163A.

In this exemplary embodiment, the exhaust port 161 is located above the inlet 163A.

In this exemplary embodiment, the air flow path 163 includes a first portion 163M and a second portion 163K, in both of which downstream-side portions in the airflow direction are located at higher positions than the other portions.

In this exemplary embodiment, the second portion 163K is located downstream of the first portion 163M in the airflow direction.

The second portion 163K is located above the first portion 163M. In this exemplary embodiment, the inclination angle of the second portion 163K with respect to the horizontal direction is smaller than the inclination angle of the first portion 163M with respect to the horizontal direction.

Furthermore, in this exemplary embodiment, the first portion 163M and the second portion 163K are connected to each other at a connecting point 163CP.

More specifically, in this exemplary embodiment, the air flow path 163 extends toward the downstream side in the airflow direction and has a bent portion in the middle thereof.

More specifically, the air flow path 163 extends in one direction up to the connecting point 163CP and then extends in a direction intersecting the one direction from the connecting point 163CP.

Furthermore, in this exemplary embodiment, a discharge portion 163C, from which the air in the air flow path 163 is discharged, is provided. The discharge portion 163C is, for example, a circular hole and is provided in an inner surface 141E of the container 141 (upper housing 142B).

The discharge portion 163C is provided between the inlet 163A and the end 163B of the air flow path 163. More specifically, the discharge portion 163C is provided in the second portion 163K of the air flow path 163. More specifically, the discharge portion 1630 is provided in the second portion 163K, at a position near the end 163B. The discharge portion 163C is provided above the second portion 163K.

Although the discharge portion 163C may be provided at any position, it is desirable that the discharge portion 163C be provided at a position closer to the end 163B. More specifically, it is desirable that the discharge portion 163C be provided at a position closer to the end 163B than the midpoint of the line segment connecting the inlet 163A and the end 163B (i.e., the line segment extending along the air flow path 163) is.

In this exemplary embodiment, a connecting flow path 163E, which connects the discharge portion 163C and the exhaust port 161 and through which the air directed to the exhaust port 161 passes, is provided.

In this exemplary embodiment, the air inside the air flow path 163 is discharged outside the air flow path 163 through the discharge portion 163C. The air is directed to the exhaust port 161 through the connecting flow path 163E and is discharged from the exhaust port 161.

Part of the inner surface 141E of the container 141 (upper housing 142B) constitutes the air flow path 163. In other words, in this exemplary embodiment, a portion of the inner surface 141E of the container 141 faces the air flow path 163.

The air flow path 163 according to this exemplary embodiment is a gap G formed between the inner surface 141E of the container 141 (the upper housing 142B) and a facing part 168 that faces the inner surface 141E.

More specifically, a plate-shaped facing member 169 is disposed inside the container 141 so as to face the inner surface 141E of the container 141, thus forming the gap G, serving as the air flow path 163, between the inner surface 141E of the container 141 and the facing member 169.

Furthermore, in this exemplary embodiment, as shown in FIG. 2, the inlet 163A of the air flow path 163 is located above the magnetic pole N3 (attachment magnetic pole) in the top-bottom direction.

In this exemplary embodiment, as shown in FIG. 2, the inlet 163A is located farther from the magnetic pole N3 (attachment magnetic pole) than the rotation axis 146X of the first transport member 146 is, in the horizontal direction.

In this exemplary embodiment, in FIG. 2, the inlet 163A is located to the right of the rotation axis 146X of the first transport member 146, and the magnetic pole N3 is located to the left of the rotation axis 146X.

In this exemplary embodiment, the developer attaches to the surface of the developing sleeve 145A, at a position corresponding to the magnetic pole N3.

The developer attached to the surface of the developing sleeve 145A moves upward along a movement path 2X. If the inlet 163A is near the movement path 2X, the developer is likely to enter the inlet 163A. If the developer enters the inlet 163A, the developer is likely to be discharged from the exhaust port 161.

In contrast, as in this exemplary embodiment, in the configuration in which the inlet 163A is located farther from the magnetic pole N3 than the rotation axis 146X of the first transport member 146 is, the inlet 163A is distant from the movement path of the developer. Hence, the developer does not easily reach the inlet 163A.

Furthermore, in this exemplary embodiment, as described above, the magnetic pole N4 (pickoff pole), together with the magnetic pole N3 adjacent thereto, forms a repulsive magnetic field. Thus, the developer attached to the surface of the developing sleeve 145A comes off the developing sleeve 145A and returns to the first transport member 146.

In this case, if the inlet 163A is located below the magnetic pole N3, the developer is likely to reach the inlet 163A.

More specifically, the developer drops from the surface of the developing sleeve 145A toward the first transport member 146 and is likely to be blown up in the air at the positions corresponding to the magnetic pole N4 and the magnetic pole N3. At this time, if the inlet 163A is located below the magnetic pole N3, the blown-up developer is likely to reach the inlet 163A.

In contrast, as in this exemplary embodiment, if the inlet 163A is located above the magnetic pole N3, the inlet 163A is distant from the position where the developer is blown up in the air. Hence, the developer is unlikely to reach the inlet 163A.

Figure 4:
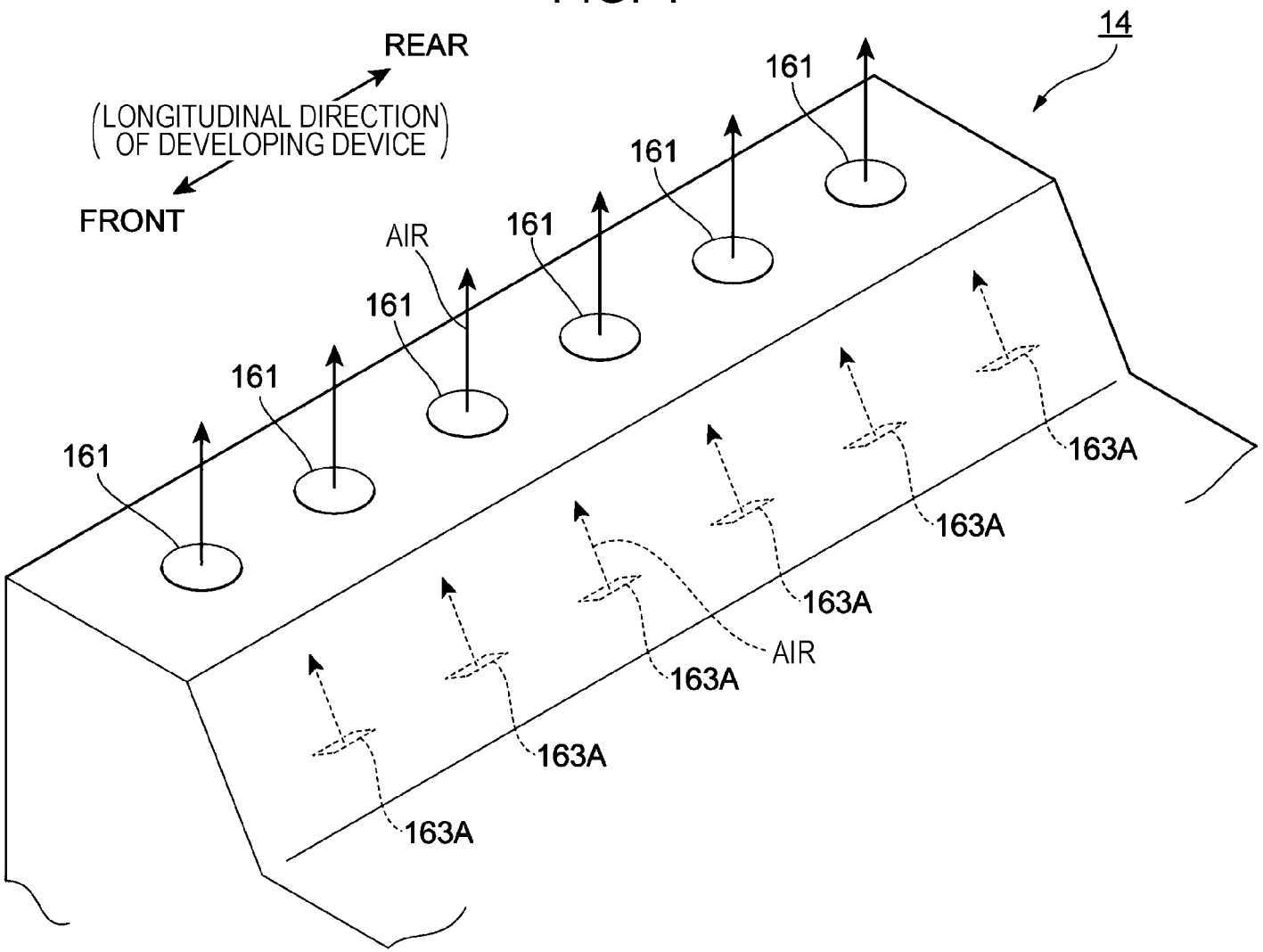
FIG. 4 shows the developing device, as viewed in the arrow IV direction in FIG. 2, that is, from the front side of the image forming apparatus.

FIG. 4 shows the developing device 14, as viewed in the arrow IV direction in FIG. 2, that is, from the front side of the image forming apparatus 1.

In this exemplary embodiment, there are multiple inlets 163A and multiple exhaust ports 161. The inlets 163A and the exhaust ports 161 are provided side-by-side in the longitudinal direction of the developing device 14.

Furthermore, in this exemplary embodiment, the total area of the inlets 163A is smaller than the total area of the exhaust ports 161.

The total area of the inlets 163A is, in the case where there is a single inlet 163A, the area of the inlet 163A and is, in the case where there are more than one inlet 163A, the total of the areas of the inlets 163A.

Similarly, the total area of the exhaust ports 161 is, in the case where there is a single exhaust port 161, the area of the exhaust port 161 and is, in the case where there are more than one exhaust port 161, the total of the areas of the exhaust ports 161.

Furthermore, in this exemplary embodiment, the air pressure at the exhaust ports 161 is the atmospheric pressure. The air pressure at the exhaust ports 161 is lower than the air pressure at the inlets 163A.

Figure 5:
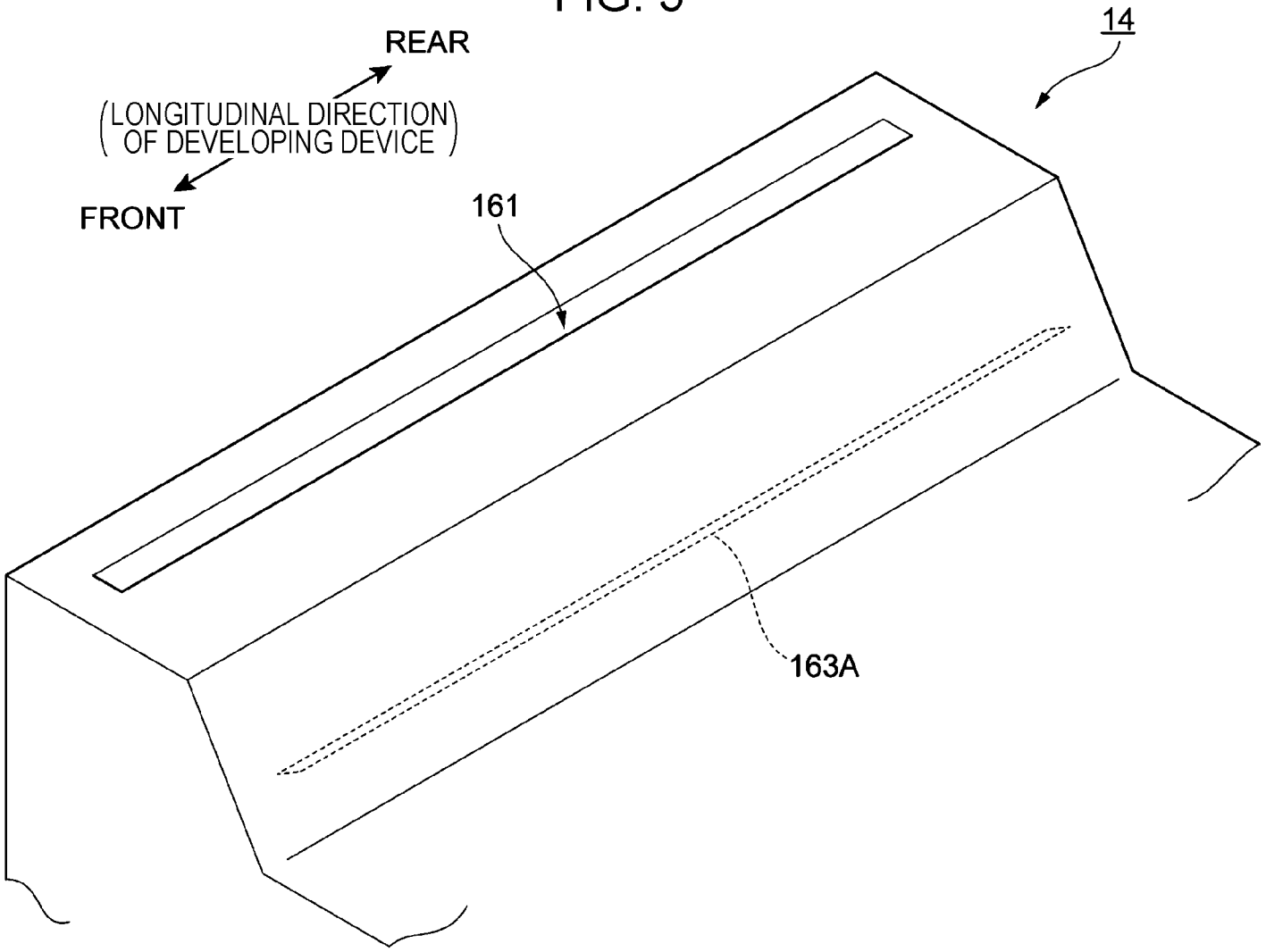
FIG. 5 shows another configuration of the developing device.

The shapes of the inlets 163A and the exhaust ports 161 and how they are arranged are not specifically limited. For example, as shown in FIG. 5, which shows another configuration of the developing device 14, a single inlet 163A and a single exhaust port 161 extending in the longitudinal direction of the developing device 14 may be formed.

Figure 6:
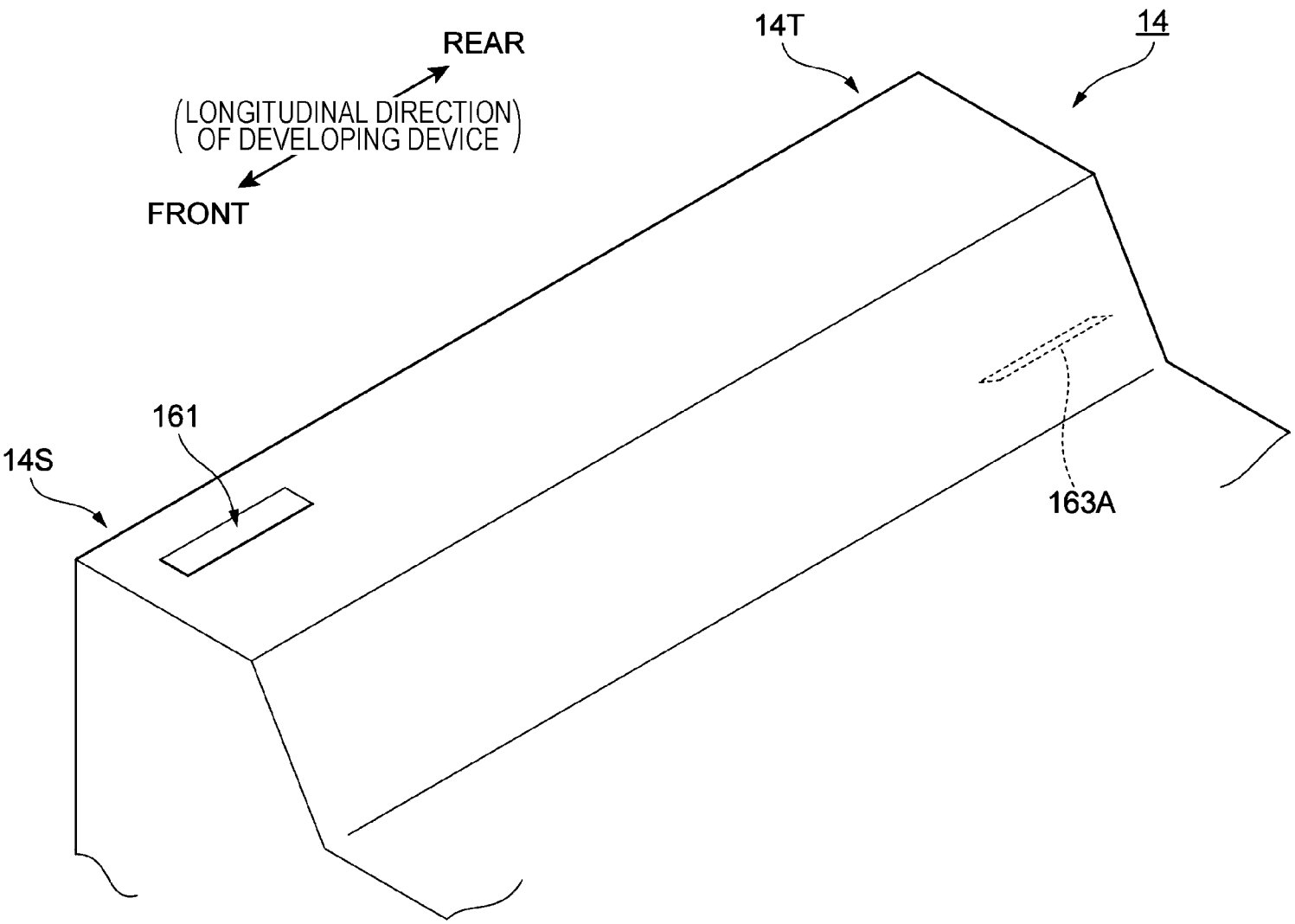
FIG. 6 shows another configuration of the developing device.

FIG. 6 shows another configuration of the developing device 14.

In this configuration example, the exhaust port 161 is provided at one end 14S (front-side end) in the longitudinal direction of the developing device 14, and the inlet 163A is provided at the other end 14T (rear-side end) in the longitudinal direction of the developing device 14.

In other words, in this configuration example, the positions of the exhaust port 161 and the inlet 163A in the longitudinal direction of the developing device 14 are different.

In this configuration example, the length of the air flow path between the inlet 163A and the exhaust port 161 is larger than that in the configuration in which the positions of the exhaust port 161 and the inlet 163A in the longitudinal direction of the developing device 14 are aligned.

In this configuration, the amount of the developer contained in the air discharged from the exhaust port 161 is smaller than that in the configuration in which the positions of the exhaust port 161 and the inlet 163A are aligned, and thus, the length of the air flow path is small.

More specifically, as the length of the air flow path increases, the amount of the developer deposited on the inner wall surrounding the air flow path increases, and thus, the amount of the developer contained in the air discharged from the exhaust port 161 decreases.

More specifically, in the configuration of this exemplary embodiment, the developer contained in the air is deposited on the inner surface 141E (see FIG. 3) and the facing part 168 while the air passes through the air flow path 163. If the length of the air flow path 163 is large, the amount of the developer deposited on the inner surface 141E or the facing part 168 is large, and thus, the amount of the developer contained in the air discharged from the exhaust port 161 is small.

Also in the configuration example shown in FIG. 6, the total area of the inlet 163A is smaller than the total area of the exhaust port 161.

Figure 7:
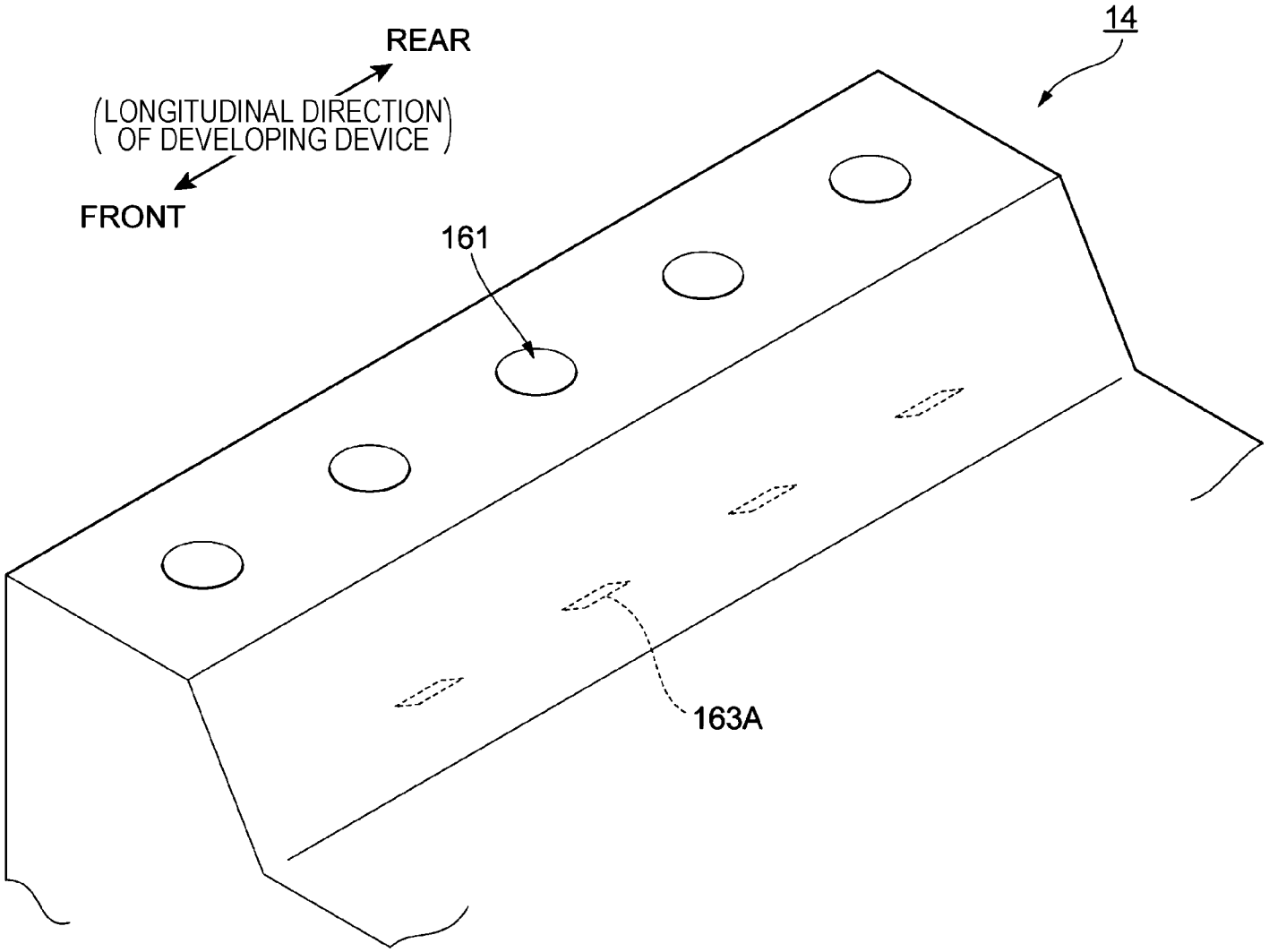
FIG. 7 shows another configuration of the developing device.

Although FIG. 6 shows a configuration example in which a single inlet 163A and a single exhaust port 161 are provided, even in the configuration in which multiple inlets 163A and multiple exhaust ports 161 are provided as shown in FIG. 7, which shows another configuration of the developing device 14, the inlets 163A and the exhaust ports 161 may be provided at different positions in the longitudinal direction of the developing device 14.

Also in such a configuration, the length of the air flow paths is larger than that in the configuration in which the positions of the inlets 163A and the exhaust ports 161 are aligned, and thus, the amount of the developer contained in the air discharged from the exhaust ports 161 is small.

Figure 8:
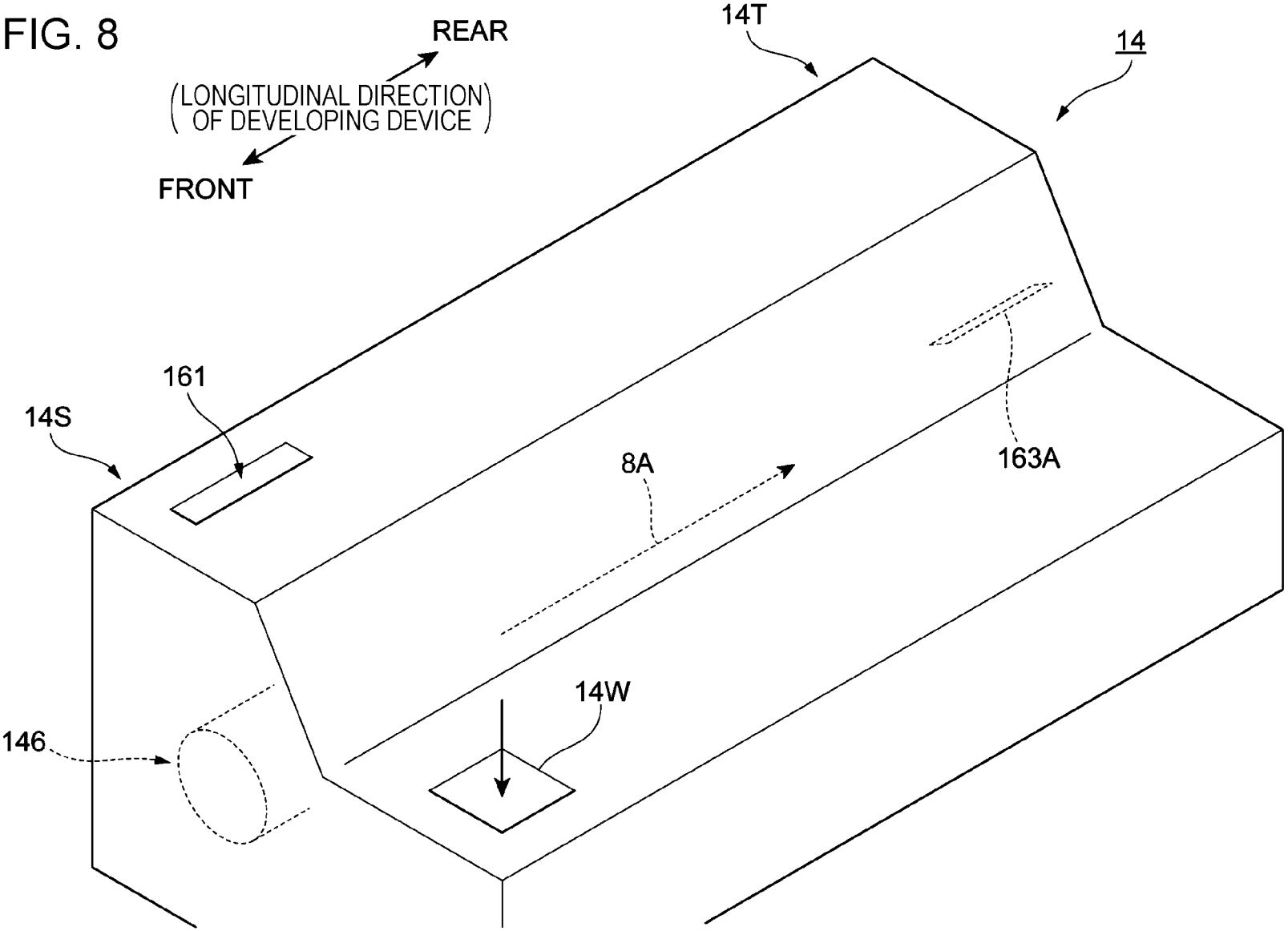
FIG. 8 shows another configuration of the developing device.

FIG. 8 shows another configuration of the developing device 14.

FIG. 8 shows a receiving port 14W from which the developer coming from the developer container 19 (see FIG. 1) is received. The receiving port 14W is provided above the second space 148B (see FIG. 2). The developer supplied to the developing device 14 through the receiving port 14W is first supplied to the second space 148B.

In this configuration example, the receiving port 14W is provided at the one end 14S in the longitudinal direction of the developing device 14. In this exemplary embodiment, the inlet 163A is provided at the other end 14T in the longitudinal direction.

In this configuration example, the developer fallen from above is supplied to the receiving port 14W. The developer is likely to be blown up in the air near the receiving port 14W. Hence, if the inlet 163A is located near the receiving port 14W, the blown-up developer is likely to reach the inlet 163A.

As in this exemplary embodiment, in the configuration in which the receiving port 14W is provided at the one end 14S, and the inlet 163A is provided at the other end 14T in the longitudinal direction of the developing device 14, the blown-up developer is unlikely to reach the inlet 163A.

In the configuration in which the receiving port 14W is provided at the one end 14S and the inlet 163A is provided at the other end 14T, the distance between the receiving port 14W and the inlet 163A is larger than that in the configuration in which both the receiving port 14W and the inlet 163A are provided at the same end. Hence, the blown-up developer is unlikely to reach the inlet 163A.

Furthermore, in this configuration example, the first transport member 146 transports the developer from the one end 14S toward the other end 14T in the longitudinal direction of the developing device 14.

In this configuration example, the inlet 163A is provided at the other end 14T of the developing device 14, to which the first transport member 146 transports the developer. Hence, the developer is unlikely to reach the inlet 163A, compared with the configuration in which the inlet 163A is provided at the one end 14S.

The developer that is newly supplied to the developing device 14 through the receiving port 14W moves to the downstream side while being stirred by the first transport member 146.

More specifically, the developer moves in the arrow 8A direction while being stirred by the first transport member 146. In this configuration example, the charge level of the developer increases as the developer moves. As the charge level of the developer increases, the developer becomes less likely to be scattered.

The charge level of the developer at the one end 14S of the developing device 14 is lower than that at the other end 14T. Hence, the developer is likely to be scattered at the one end 14S.

On the other hand, the charge level of the developer at the other end 14T of the developing device 14 is higher than that at the one end 14S of the developing device 14. Hence, the developer is unlikely to be scattered.

Accordingly, in this configuration example, the inlet 163A is provided at the other end 14T. By doing so, the developer is less likely to reach the inlet 163A than in the configuration in which the inlet 163A is provided at the one end 14S.

Furthermore, in this exemplary embodiment, as shown in FIG. 2, a recess 14Z is provided in the inner surface 141E of the container 141. The inlet 163A according to this exemplary embodiment faces the recess 14Z.

More specifically, in this exemplary embodiment, the recess 14Z, which has a V-shaped sectional view, is provided in the area between a first inner surface 141E1 (i.e., the inner surface that is inclined with respect to the horizontal direction and the vertical direction) extending in an oblique direction and a second inner surface 141E2 (i.e., one side surface of the upper partition wall 148U) extending in the top-bottom direction.

In this exemplary embodiment, the inlet 163A is provided so as to be adjacent to face the recess 14Z.

More specifically, in this exemplary embodiment, the second inner surface 141E2 is located at a position facing the inlet 163A. In this exemplary embodiment, the second inner surface 141E2 is located on a portion extending from the first portion 163M of the air flow path 163, and the portion extending from the first portion 163M and the second inner surface 141E2 intersect.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a container for accommodating developer, the container having an exhaust port and an opening;

an air flow path having an inlet of air directed to the exhaust port and through which the air passes;

a cylindrical rotation member disposed at the opening in the container and is rotated such that a portion thereof facing the interior of the container moves upward;

a transport member that rotates about a rotation axis extending along the rotation member and transports the developer inside the container; and an attachment magnetic pole that is disposed inside the rotation member and that allows the developer transported by the transport member to attach to the rotation member, wherein the inlet of the air flow path is located above the attachment magnetic pole in a top-bottom direction, and the inlet is located farther from the attachment magnetic pole than the rotation axis of the transport member is in the horizontal direction.

2. The developing device according to claim 1, wherein the total area of the inlet is smaller than the total area of the exhaust port.

3. The developing device according to claim 1, wherein the air pressure at the exhaust port is lower than the air pressure at the inlet.

4. The developing device according to claim 1, wherein part of an inner surface of the container constitutes the air flow path.

5. The developing device according to claim 4, wherein a gap between the inner surface of the container and a facing part corresponding to the inner surface serves as the air flow path.

6. The developing device according to claim 1, wherein the air flow path has a portion in which a more downstream portion in a direction in which the air flows through the air flow path is located at a higher position.

7. The developing device according to claim 1, wherein the exhaust port is located above the inlet.

8. The developing device according to claim 1, wherein the exhaust port and the inlet are provided at different positions in the longitudinal direction of the developing device.

9. The developing device according to claim 8, wherein the exhaust port is provided at one end and the inlet is provided at the other end in the longitudinal direction of the developing device.

10. The developing device according to claim 1, wherein the developing device has a receiving port from which developer to be supplied to the developing device is supplied, and the receiving port is provided at one end and the inlet is provided at the other end in the longitudinal direction of the developing device.

11. The developing device according to claim 1, wherein the transport member transports the developer from one end to the other end in the longitudinal direction of the developing device, and the inlet is provided at the other end of the developing device.

12. The developing device according to claim 1, wherein the air flow path is formed so as to extend downstream in a direction in which the air flows through the air flow path and is bent in the middle thereof.

13. The developing device according to claim 1, wherein a recess is provided in the inner surface of the container, and the inlet is provided so as to face the recess.

14. An image forming apparatus comprising:

an image carrier that carries an image; and the developing device according to claim 1, which forms an image on the image carrier.

* * * * *